US010450042B2

(12) United States Patent
Gottlieb

(10) Patent No.: US 10,450,042 B2
(45) Date of Patent: Oct. 22, 2019

(54) PADDLE

(76) Inventor: Steve Gottlieb, Ponce Inlet, FL (US)

( * ) Notice: Subject to any disclaimer, the term of this patent is extended or adjusted under 35 U.S.C. 154(b) by 769 days.

(21) Appl. No.: 13/347,806

(22) Filed: Jan. 11, 2012

(65) Prior Publication Data

US 2013/0174400 A1 Jul. 11, 2013

(51) Int. Cl.
*B63H 16/04* (2006.01)

(52) U.S. Cl.
CPC ..... *B63H 16/04* (2013.01); *Y10T 29/49826* (2015.01)

(58) Field of Classification Search
CPC ..... B23P 11/00; B23P 13/00; B23P 15/00; B63H 16/04; B63H 2016/04; B63H 2016/046; B27F 1/08; B27M 3/0013; B27M 3/0066; B27M 3/22; B29L 2031/5209; B29L 2031/5245; F16B 5/12; F16B 5/121; A63B 59/04; A63B 59/18; A63B 59/185; A63B 71/0054; A63B 2102/02–2102/04; A63B 2012/08; A63B 2102/16; Y10T 403/7045
USPC ..... 440/101–103; 416/74; 29/458, 525.01, 29/527.1, 527.2, 557, 558
See application file for complete search history.

(56) References Cited

U.S. PATENT DOCUMENTS

| | | | | | |
|---|---|---|---|---|---|
| 936,165 | A * | 10/1909 | Richardson | 416/70 R | |
| 2,191,287 | A * | 2/1940 | Perryman | 473/529 | |
| 3,879,035 | A * | 4/1975 | Danchulis et al. | 473/527 | |
| 4,128,239 | A * | 12/1978 | Grenadier | 473/530 | |
| 4,130,277 | A * | 12/1978 | Marks | 473/527 | |
| 4,379,554 | A * | 4/1983 | Schuyler et al. | 473/530 | |
| 4,610,633 | A | 9/1986 | Freudenberg | | |
| 5,273,472 | A | 12/1993 | Skedeleski et al. | | |
| 2007/0173143 | A1 | 7/2007 | McCarthy | | |
| 2010/0009580 | A1 | 1/2010 | Gomez Escobar | | |
| 2010/0104448 | A1* | 4/2010 | Moore | 416/235 | |
| 2013/0056509 | A1* | 3/2013 | Fuller | B63B 35/7933 224/406 | |

OTHER PUBLICATIONS

"Paddle Edge Guard", C4Waterman, first accessed Feb. 7, 2014, http://web.archive.org/web/20070613021019/http://store.c4waterman.com/Paddle-Guard-p/surfco-paddleguard.htm.*

* cited by examiner

*Primary Examiner* — Matthew P Travers
(74) *Attorney, Agent, or Firm* — Douglas J Visnius

(57) ABSTRACT

According to one embodiment of the invention, a method for an improved paddle may include fabricating a relief on the paddle blade's border. The method may also include securely fastening an impact absorbent material to the relief on the paddle blade's border to produce the improved paddle.

20 Claims, 13 Drawing Sheets

PADDLE

BACKGROUND OF THE INVENTION

1. Field of the Invention

The invention relates to the field of paddles, and more particularly to human powered paddles.

2. Description of Background

There are many different types of paddles used by people to propel a watercraft such as a canoe, kayak, stand-up paddle ("SUP") board, and/or the like through the water. Generally, the paddle includes a paddle blade attached to a shaft that the person grasps and manipulates to power the watercraft across a body of water.

SUMMARY OF THE INVENTION

According to one embodiment of the invention, a method for an improved paddle may include fabricating a relief on the paddle blade's border. The method may also include securely fastening an impact absorbent material to the relief on the paddle blade's border to produce the improved paddle.

The relief may be fabricated on both a front side and a back side of the paddle blade's border. The impact absorbent material may cover at least a distal lower two fifths of the paddle blade's border with respect to a paddle shaft that carries the paddle blade's border.

The impact absorbent material may deform elastically. The paddle blade's border may begin adjacent to a paddle shaft that carries a paddle blade that includes the paddle blade's border, and the paddle blade's border continues around the paddle blade's tip and terminates near another side of the paddle shaft.

The relief may engage the impact absorbent material to reduce movement of the impact absorbent material with respect to the paddle blade's border, and the engagement may comprise a mated mechanical interface that aids in securely positioning the impact absorbent material with respect to the paddle blade's border. The impact absorbent material may aid in protecting a watercraft's side from damage when the paddle blade carrying the paddle blade's border with the impact absorbent material is used.

The method may further include maintaining a flush interface of the paddle blade's border and the impact absorbent material. The method may additionally include tapering to an edge the impact absorbent material away from the paddle blade's border to reduce hydrodynamic resistant characteristics of the paddle blade carrying the paddle blade's border and the impact absorbent material.

In another embodiment, the method includes fabricating a relief on a paddle blade's border. The method may also include securely fastening an impact absorbent material that deforms elastically to the relief on the paddle blade's border to produce an improved paddle that aids in protecting a watercraft's side from damage when a paddle blade carrying the paddle blade's border with the impact absorbent material is used.

The impact absorbent material may cover at least a distal lower two fifths of the paddle blade's border with respect to a paddle shaft that carries the paddle blade's border. The paddle blade's border may begin adjacent to a paddle shaft that carries a paddle blade that includes the paddle blade's border, and the paddle blade's border may continue around the paddle blade's tip and terminates near another side of the paddle shaft. The relief may engage the impact absorbent material to reduce movement of the impact absorbent material with respect to the paddle blade's border, and the engagement may comprise a mated mechanical interface that aids in securely positioning the impact absorbent material with respect to the paddle blade's border.

The method may further include maintaining a flush interface of the paddle blade's border and the impact absorbent material. The method may additionally include tapering to an edge the impact absorbent material away from the paddle blade's border to reduce hydrodynamic resistant characteristics of a paddle blade carrying the paddle blade's border and the impact absorbent material.

In another embodiment, the method includes fabricating a relief on both a front side and a back side of a paddle blade's border. The method may also include securely fastening an impact absorbent material to the relief on at least a distal lower two fifths of the paddle blade's border with respect to a paddle shaft that carries the paddle blade's border to produce an improved paddle.

The method may further include maintaining a flush interface of the paddle blade's border and the impact absorbent material. The method may additionally include tapering to an edge the impact absorbent material away from the paddle blade's border to reduce hydrodynamic resistant characteristics of a paddle blade carrying the paddle blade's border and the impact absorbent material.

DETAILED DESCRIPTION OF THE INVENTION

Various embodiments of the invention will now be described more fully hereinafter with reference to the accompanying drawings, in which preferred embodiments of the invention are shown. Like numbers refer to like elements throughout.

Figure 1:
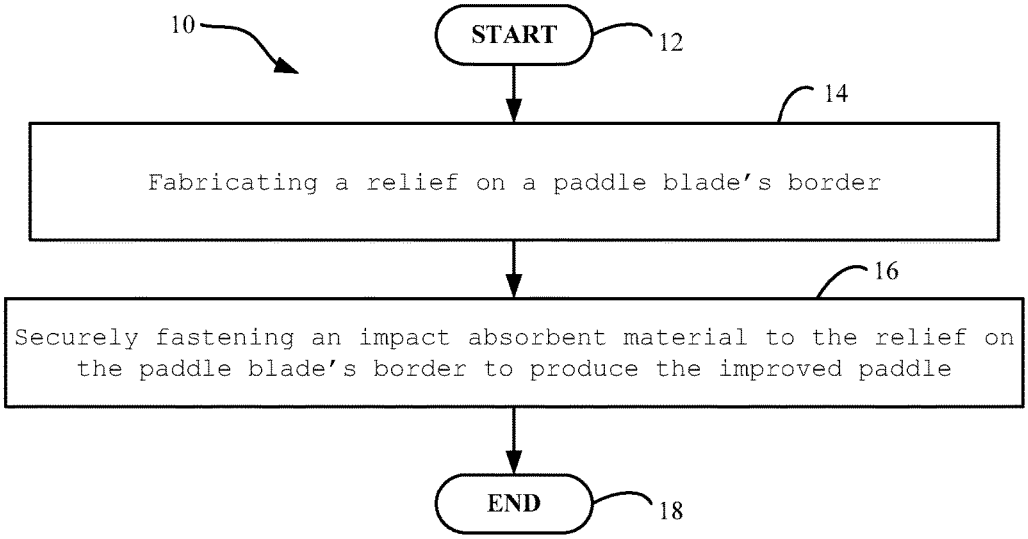
FIG. 1 is a flowchart illustrating method aspects according to the invention.

One aspect of the invention is a method for improving a paddle, which is initially described with reference to flowchart 10 of FIG. 1. The method begins at Block 12 and may include fabricating a relief on the paddle blade's border at Block 14. The method may also include securely fastening an impact absorbent material to the relief on the paddle blade's border to produce the improved paddle at Block 16. The method ends at Block 18.

Figure 2:
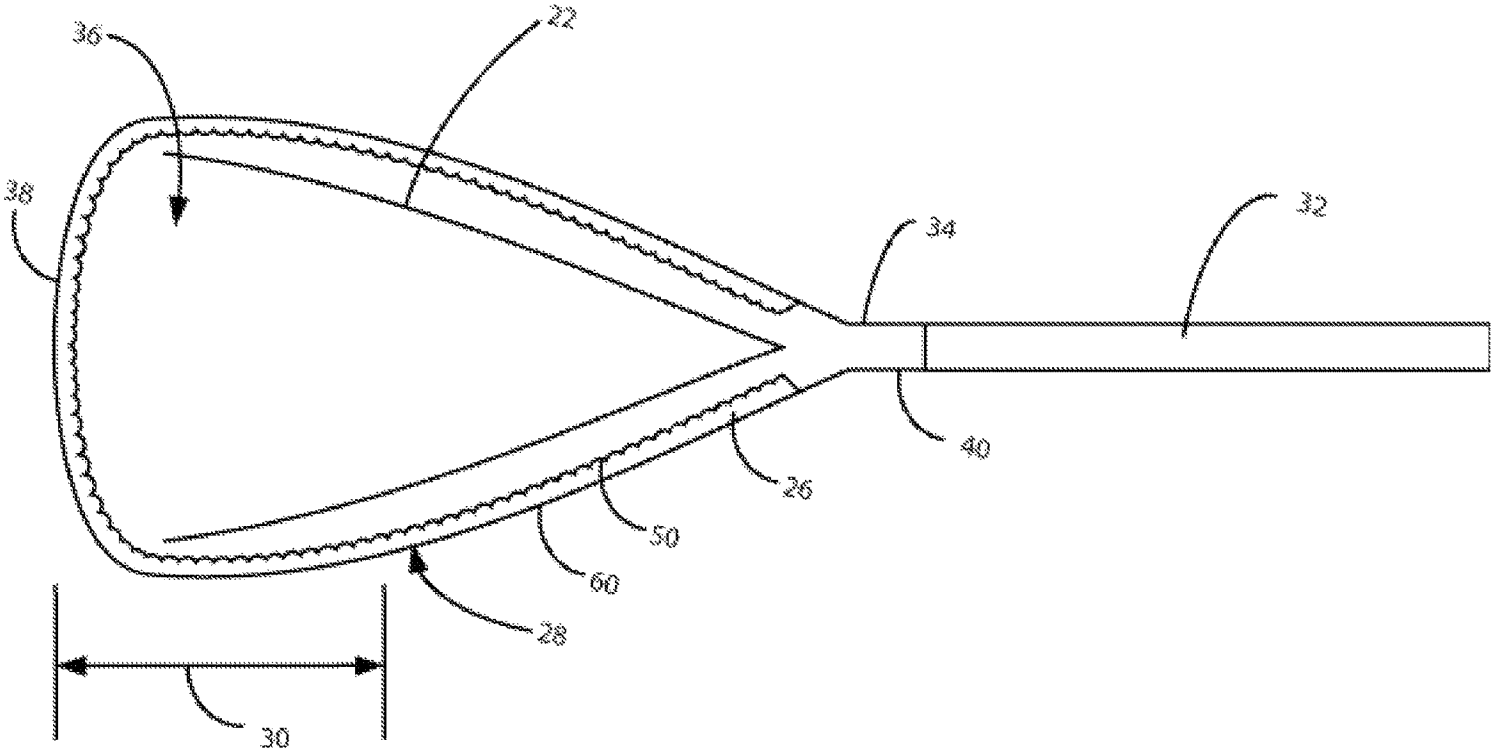
FIG. 2 is an exemplary illustration of a paddle in accordance with the invention.
Figure 11:
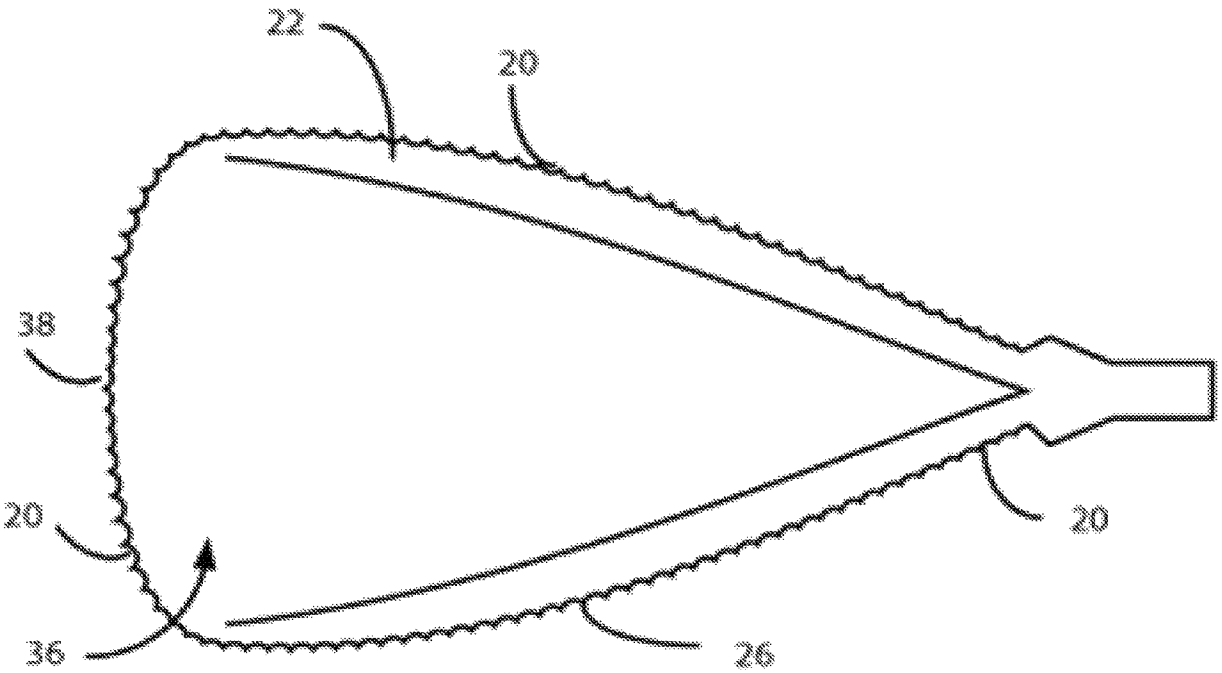
FIG. 11 is an exemplary illustration of an alternative paddle blade without the impact absorbent material in accordance with the invention.

In one embodiment and with additional reference to FIGS. 2 and 11, the relief 20 may be fabricated on both a front side 22 and a back side of the paddle blade's border 26. In another embodiment, the relief 20 is a removal of material from the paddle blade's border 26.

Figure 12:
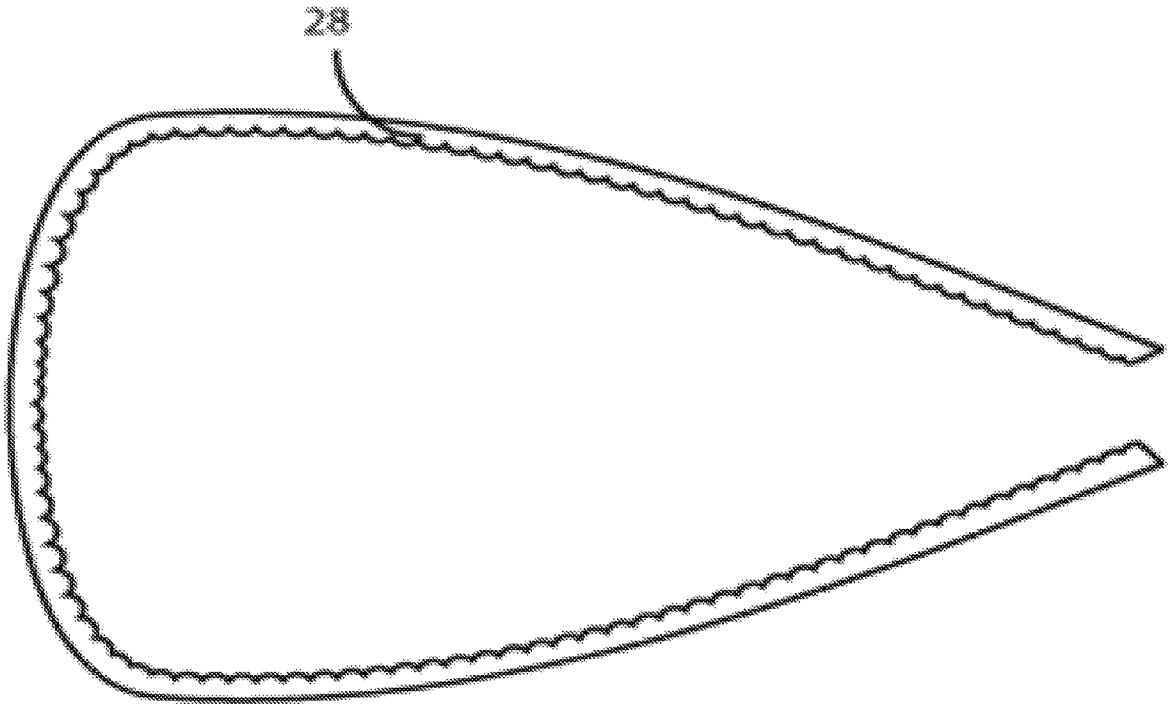
FIG. 12 is an exemplary illustration of an impact absorbent material in accordance with FIGS. 2 and 13.

In one embodiment, the impact absorbent material 28 covers at least a distal lower two fifths 30 of the paddle blade's border 26 with respect to a paddle shaft 32 that carries the paddle blade's border. In another embodiment and with additional reference to FIG. 12, the impact absorbent material 28 comprises shock absorbing polymers, rubber, neoprene, silicone, and/or the like.

In one embodiment, the impact absorbent material 28 deforms elastically. In another embodiment, the paddle blade's border 26 begins adjacent to one side 34 of the paddle shaft 32 that carries a paddle blade 36 that includes the paddle blade's border, and the paddle blade's border continues around the paddle blade's tip 38 and terminates near the other side 40 of the paddle shaft.

In one embodiment, the relief engages the impact absorbent material 28 to reduce movement of the impact absorbent material with respect to the paddle blade's border 26. In other words, the relief 20 comprises a socket-like structure into which the impact absorbent material 28 fits so that the engagement comprises a mated mechanical interface that aids in securely positioning the impact absorbent material with respect to the paddle blade's border 26.

In one embodiment, the impact absorbent material 28 aids in protecting a watercraft's side (not shown) from damage when the paddle blade 36 carrying the paddle blade's border 26 with the impact absorbent material 28 is used. For example, SUP boards can be damaged by a prior art paddle blade striking the side of the board. In contrast, the impact absorbent material 28 on the paddle blade's border 26 would aid in protecting the watercraft's side during a similar paddle blade strike of the SUP board because it can elastically deform and/or absorb energy generated by the paddle blade strike.

Figure 3:
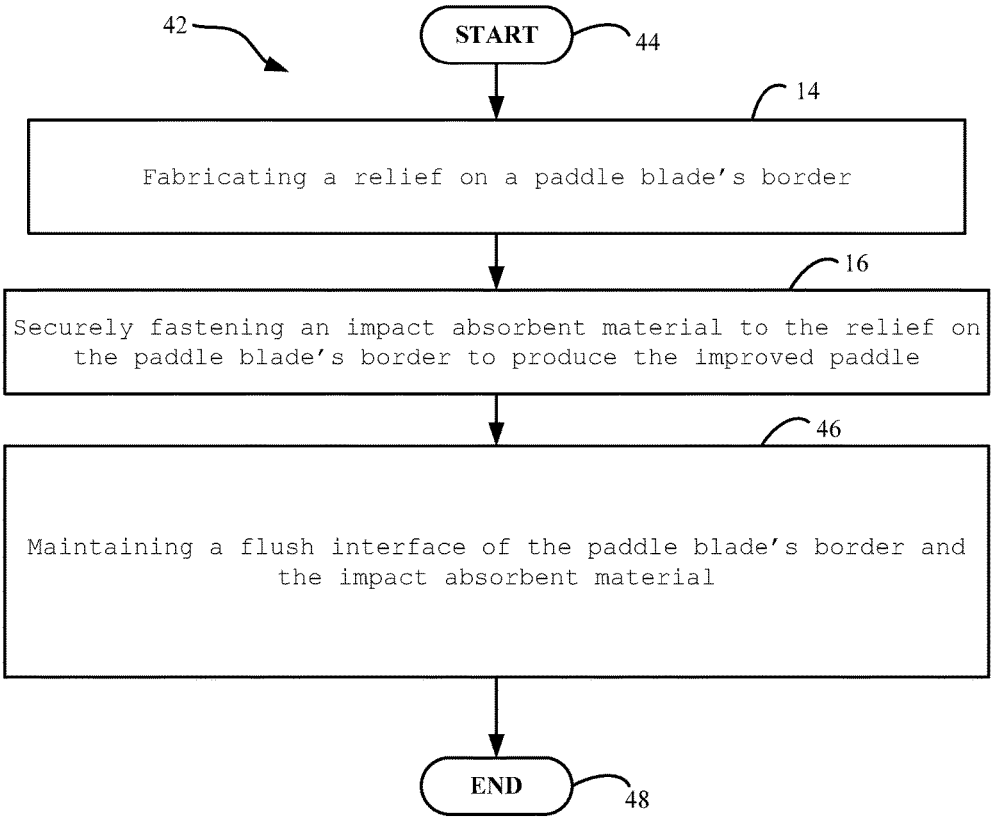
FIG. 3 is a flowchart illustrating method aspects according to the method of FIG. 1.

In another method embodiment, which is now described with reference to flowchart 42 of FIG. 3, the method begins at Block 44. The method may include the steps of FIG. 1 at Blocks 14 and 16. The method may further include maintaining a flush interface of the paddle blade's border and the impact absorbent material at Block 46. The method ends at Block 48. In one embodiment, the interface 50 is flush to reduce hydrodynamic drag as well as possible snag points in weedy areas, for instance.

Figure 13:
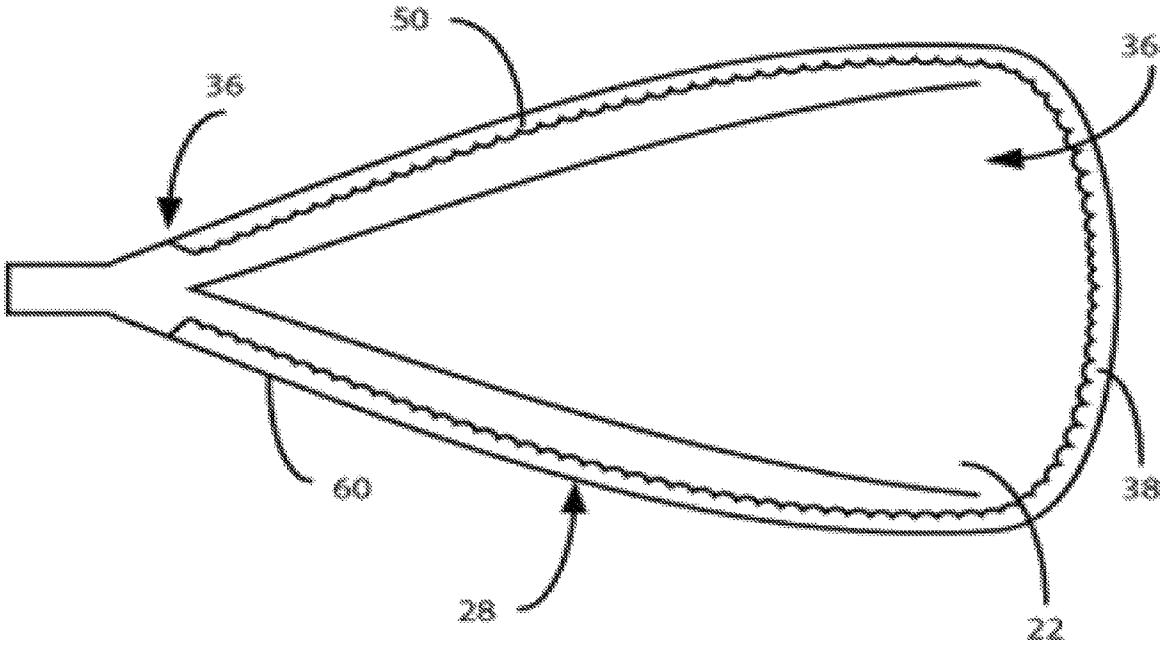
FIG. 13 is an exemplary illustration of an alternative paddle blade in accordance with the invention.

In one embodiment and with additional reference to FIG. 13, the interface 50 securely fastens the paddle blade's border 26 with the impact absorbent material 28 by molecular bonding produced during the injection molding process of the two components. In another embodiment, the interface 50 securely fastens the paddle blade's border 26 with the impact absorbent material 28 by adhesion, fasteners, welding, and/or the like.

Figure 4:
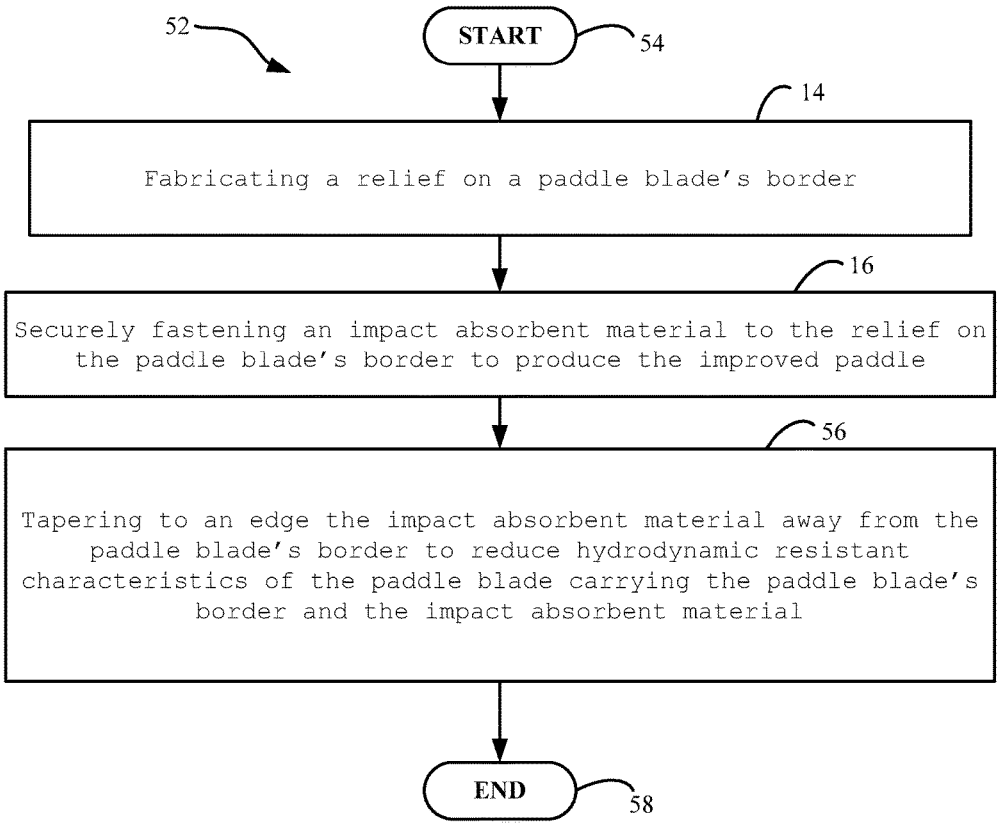
FIG. 4 is a flowchart illustrating method aspects according to the method of FIG. 1.

In another method embodiment, which is now described with reference to flowchart 52 of FIG. 4, the method begins at Block 54. The method may include the steps of FIG. 1 at Blocks 14 and 16. The method may additionally include tapering to an edge the impact absorbent material away from the paddle blade's border to reduce hydrodynamic resistant characteristics of the paddle blade carrying the paddle blade's border and the impact absorbent material at Block 56. The method ends at Block 58.

For example, the tapered edge 60 of the impact absorbent material 28 will enter the water with less turbulence than an impact absorbent material with a blunt edge. In addition, the cleaner entry of the tapered edge 60 will aid in maintaining laminar flow of the water around the paddle blade 36, which means more power is transmitted to the water, e.g. more efficient, when compared to a paddle blade that induces more turbulence into the water surrounding the paddle blade.

Figure 5:
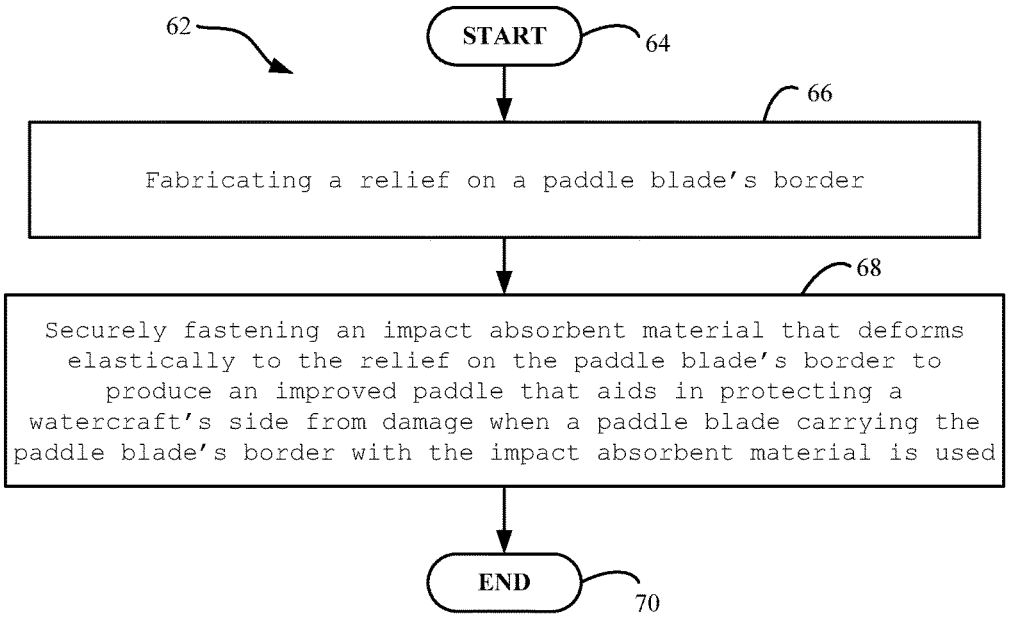
FIG. 5 is a flowchart illustrating method aspects according to the invention.

In another method embodiment, which is now described with reference to flowchart 62 of FIG. 5, the method begins at Block 64. The method may include fabricating a relief on a paddle blade's border at Block 66. The method may also include securely fastening an impact absorbent material that deforms elastically to the relief on the paddle blade's border to produce an improved paddle that aids in protecting a watercraft's side from damage when a paddle blade carrying the paddle blade's border with the impact absorbent material is used at Block 68. The method ends at Block 70.

Figure 6:
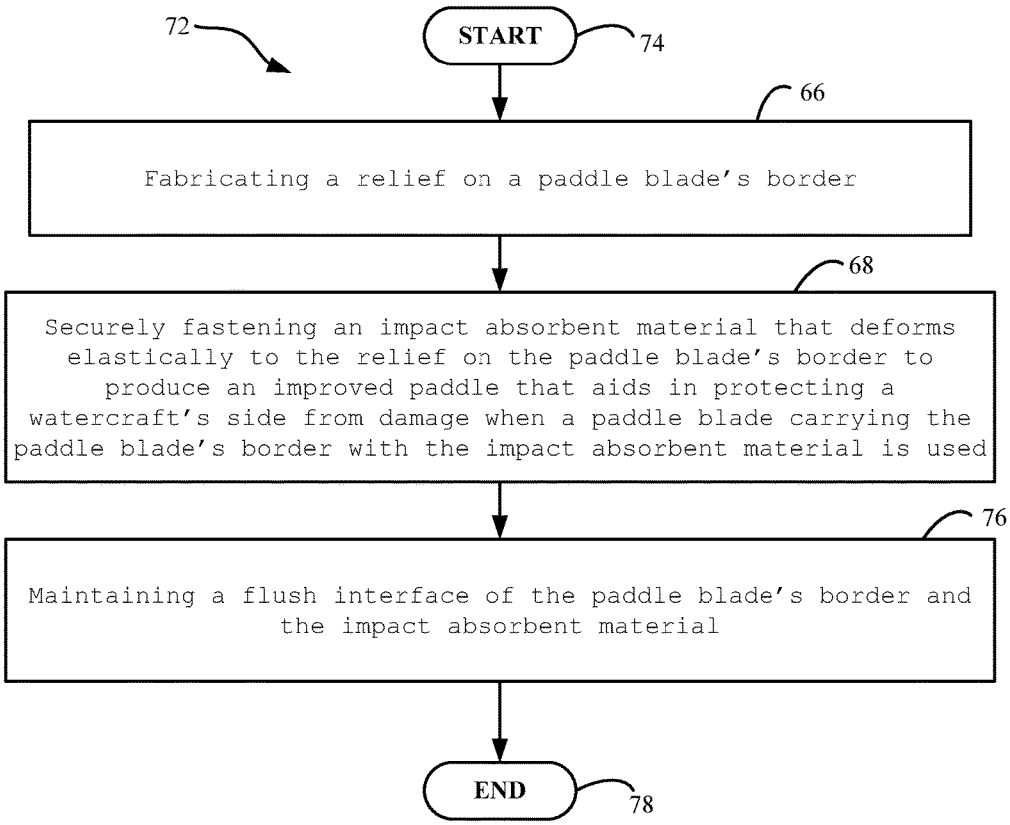
FIG. 6 is a flowchart illustrating method aspects according to the method of FIG. 5.

In another method embodiment, which is now described with reference to flowchart 72 of FIG. 6, the method begins at Block 74. The method may include the steps of FIG. 5 at Blocks 66 and 68. The method may further include maintaining a flush interface of the paddle blade's border and the impact absorbent material at Block 76. The method ends at Block 78.

Figure 7:
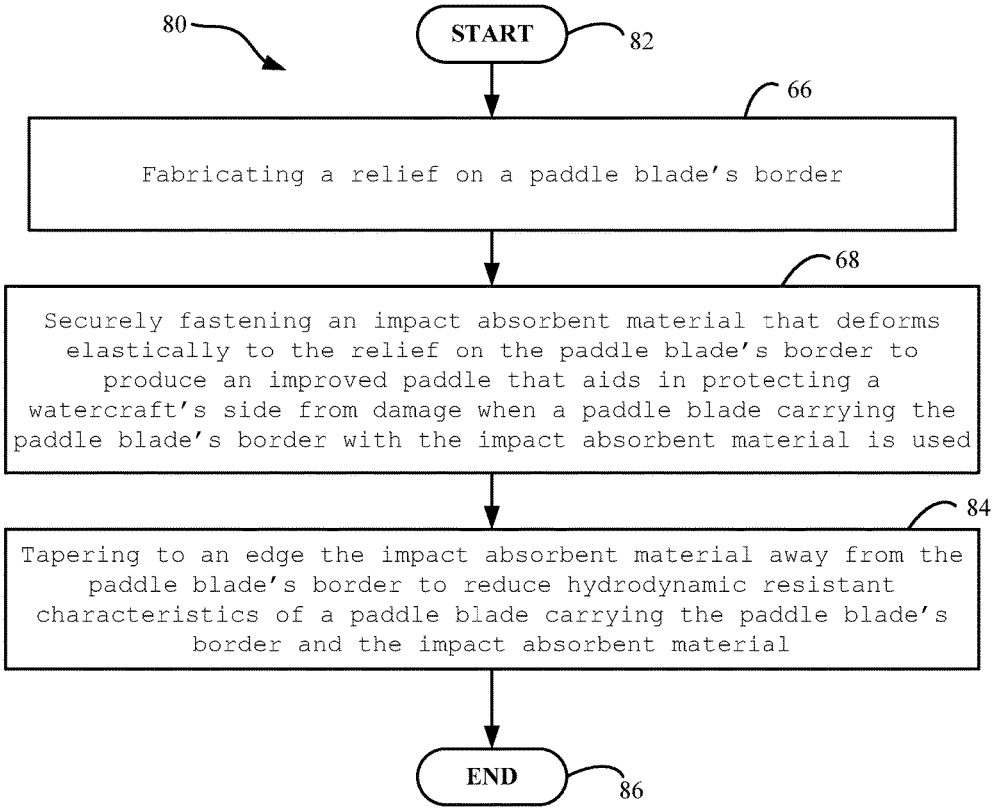
FIG. 7 is a flowchart illustrating method aspects according to the method of FIG. 5.

In another method embodiment, which is now described with reference to flowchart 80 of FIG. 7, the method begins at Block 82. The method may include the steps of FIG. 5 at Blocks 66 and 68. The method may further include tapering to an edge the impact absorbent material away from the paddle blade's border to reduce hydrodynamic resistant characteristics of a paddle blade carrying the paddle blade's border and the impact absorbent material at Block 84. The method ends at Block 86.

Figure 8:
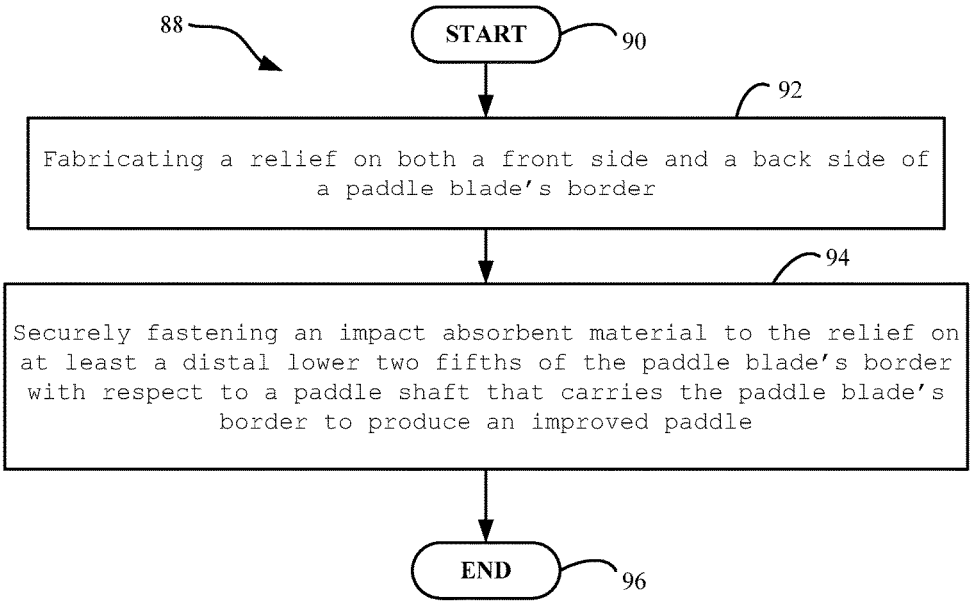
FIG. 8 is a flowchart illustrating method aspects according to the invention.

In another method embodiment, which is now described with reference to flowchart 88 of FIG. 8, the method begins at Block 90. The method includes fabricating a relief on both a front side and a back side of a paddle blade's border at Block 92. The method may also include securely fastening an impact absorbent material to the relief on at least a distal lower two fifths of the paddle blade's border with respect to a paddle shaft that carries the paddle blade's border to produce an improved paddle at Block 94. The method ends at Block 96.

Figure 9:
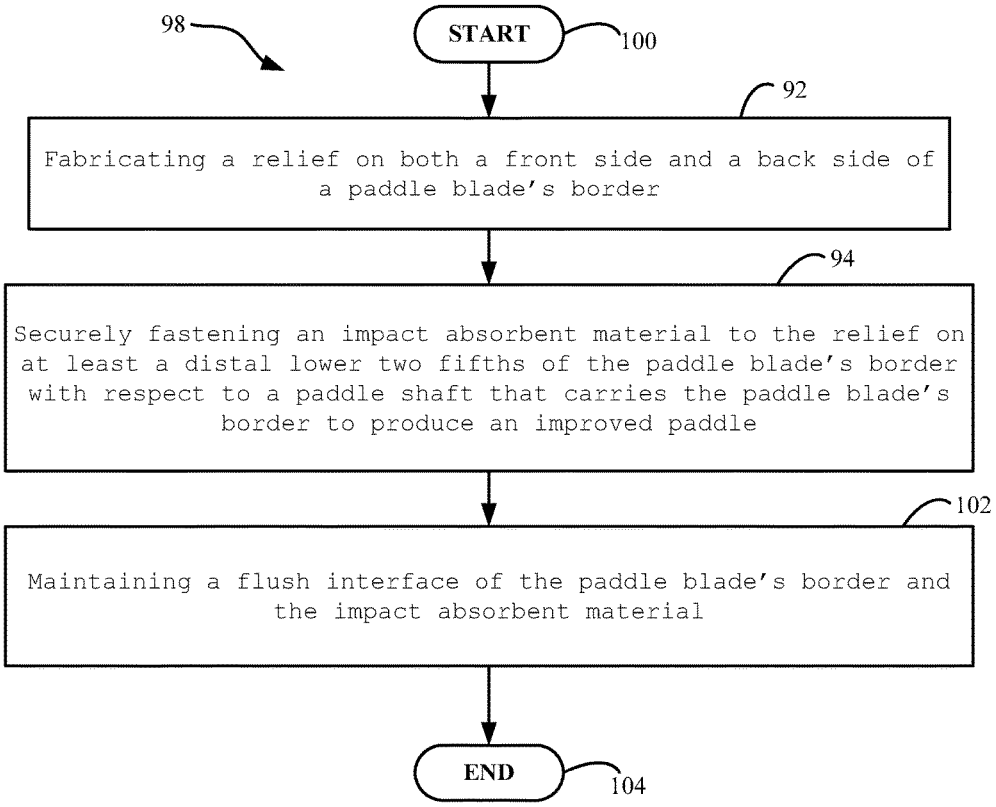
FIG. 9 is a flowchart illustrating method aspects according to the method of FIG. 8.

In another method embodiment, which is now described with reference to flowchart 98 of FIG. 9, the method begins at Block 100. The method may include the steps of FIG. 8 at Blocks 92 and 94. The method may further include maintaining a flush interface of the paddle blade's border and the impact absorbent material at Block 102. The method ends at Block 104.

Figure 10:
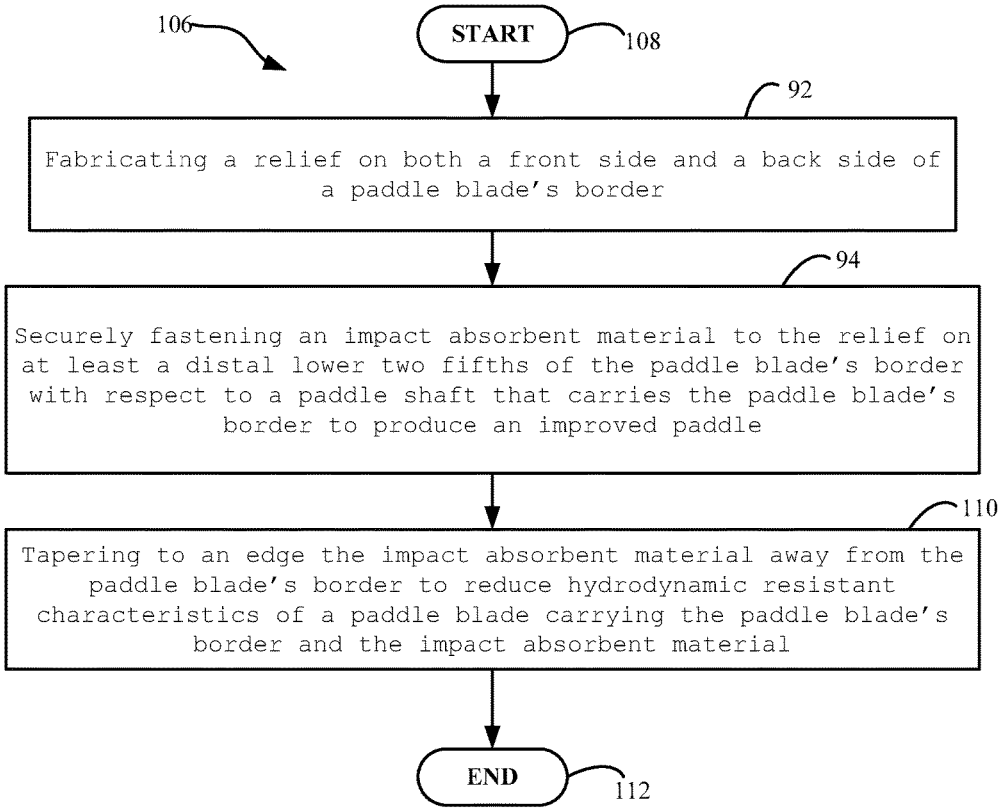
FIG. 10 is a flowchart illustrating method aspects according to the method of FIG. 8.

In another method embodiment, which is now described with reference to flowchart 106 of FIG. 10, the method begins at Block 108. The method may include the steps of FIG. 8 at Blocks 92 and 94. The method may additionally include tapering to an edge the impact absorbent material away from the paddle blade's border to reduce hydrodynamic resistant characteristics of a paddle blade carrying the paddle blade's border and the impact absorbent material at Block 110. The method ends at Block 112.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A system comprising:

an undulating relief fabricated into at least one of a solid front side and a solid back side of a paddle blade on a paddle blade's border; and an impact absorbent material securely fastened to the undulating relief on the at least one of the solid front side and a solid back side of the paddle blade and the paddle blade's border.

2. The system of claim 1 wherein the undulating relief is fabricated to make the impact absorbent material overlap the paddle blade's border and flush with at least one of the solid front side and a solid back side of the paddle blade.

3. The system of claim 2 wherein the impact absorbent material is not thicker than the paddle blade at any exterior flush interface point to aid in reducing hydrodynamic resistant characteristics of the paddle blade.

4. The system of claim 1 wherein the undulating relief is fabricated by forming a tongue centered on the paddle blade border.

5. The system of claim 1 wherein the impact absorbent material covers at least a distal lower two fifths of the paddle blade with respect to a paddle shaft that carries the paddle blade.

6. The system of claim 1 wherein the impact absorbent material is monolithic.

7. The system of claim 5 wherein the solid front side and the solid back side of the paddle blade are angled away from only one side of the paddle shaft's longitudinal axis.

8. The system of claim 1 wherein the at least one of a solid front side and a solid back side of the paddle blade and undulating relief comprise a socket and pin mated mechanical interface that aids in securely positioning the impact absorbent material with respect to the paddle blade's border.

9. The system of claim 1 wherein the paddle blade's materials are designed for water use.

10. A system comprising:

a paddle shaft;

a paddle blade connected to the shaft, the paddle blade angled away from only one side of the paddle shaft's longitudinal axis;

an undulating relief fabricated into at least one of a front side and a back side of the paddle blade on a paddle blade's border; and an impact absorbent material securely fastened to the undulating relief on the at least one of the front side and the back side of the paddle blade and the paddle blade's border.

11. The system of claim 10 wherein the undulating relief is fabricated to make the impact absorbent material overlap the paddle blade's border and flush with at least one of the front side and the back side of the paddle blade.

12. The system of claim 10 wherein the undulating relief is fabricated by forming a tongue centered on the paddle blade border.

13. The system of claim 10 wherein the impact absorbent material covers at least a distal lower two fifths of the paddle blade with respect to a paddle shaft that carries the paddle blade.

14. The system of claim 10 wherein the impact absorbent material is monolithic.

15. The system of claim 10 wherein the front side and back side of the paddle blade are solid.

16. The system of claim 10 wherein the at least one of front side and back side of the paddle blade and undulating relief comprise a socket and pin mated mechanical interface that aids in securely positioning the impact absorbent material with respect to the paddle blade's border.

17. The system of claim 10 wherein the paddle blade's materials are designed for water use.

18. The system of claim 10 wherein the impact absorbent material is not thicker than the paddle blade at any exterior flush interface point to aid in reducing hydrodynamic resistant characteristics of the paddle blade.

19. A system comprising:

a paddle shaft;

a paddle blade connected to the shaft, the paddle blade angled away from only one side of the paddle shaft's longitudinal axis;

an undulating relief fabricated into at least one of a solid-front-side and a solid-back-side of the paddle blade on a paddle blade's border; and an impact absorbent material securely fastened to the undulating relief on the at least one of the solid-front-side and the solid-back-side of the paddle blade and the paddle blade's border.

20. The system of claim 19 wherein the impact absorbent material covers at least a distal lower two fifths of the paddle blade with respect to a paddle shaft that carries the paddle blade, and the at least one of solid front side and a solid back side of the paddle blade and undulating relief comprise a socket and pin mated mechanical interface that aids in securely positioning the impact absorbent material with respect to the paddle blade's border.

* * * * *